US010468759B2

(12) United States Patent
Berioli et al.

(10) Patent No.: US 10,468,759 B2
(45) Date of Patent: Nov. 5, 2019

(54) HYBRID STEERABLE AVIONIC ANTENNA

(71) Applicant: Systems and Software Enterprises, LLC, Brea, CA (US)

(72) Inventors: Matteo Berioli, Munich (DE); Oliver Lücke, Gilching (DE)

(73) Assignee: Systems and Software Enterprises, LLC, Brea, CA (US)

( * ) Notice: Subject to any disclaimer, the term of this patent is extended or adjusted under 35 U.S.C. 154(b) by 608 days.

(21) Appl. No.: 15/161,974

(22) Filed: May 23, 2016

(65) Prior Publication Data

US 2017/0005404 A1 Jan. 5, 2017

Related U.S. Application Data

(60) Provisional application No. 62/165,633, filed on May 22, 2015.

(51) Int. Cl.
*H01Q 1/28* (2006.01)
*H01Q 3/04* (2006.01)
(Continued)

(52) U.S. Cl.
CPC ..... *H01Q 1/288* (2013.01); *H01Q 1/241* (2013.01); *H01Q 1/28* (2013.01); *H01Q 1/42* (2013.01);
(Continued)

(58) Field of Classification Search
CPC ..... H01Q 1/48; H01Q 1/288; H01Q 1/28; H01Q 3/04; H01Q 3/06; H01Q 3/26; H01Q 1/241; H01Q 1/42
See application file for complete search history.

(56) References Cited

U.S. PATENT DOCUMENTS 3,170,158 A 2/1965 Rotman
5,216,430 A * 6/1993 Rahm ..... H01Q 9/0435 343/700 MS
(Continued)

FOREIGN PATENT DOCUMENTS

EP 2738869 A1 6/2014
WO 01/11718 A1 2/2001
WO 03/003519 A1 1/2003

OTHER PUBLICATIONS

Felstead, E.B., "A Perspective on Future Naval Satcom Antennas", IEEE Military Communications Conference, Oct. 17-20, 2005.
(Continued)

*Primary Examiner* — Dieu Hien T Duong
(74) *Attorney, Agent, or Firm* — Ryan S. Dean; Umberg Zipser LLP

(57) ABSTRACT

A telecommunications antenna system for use with an aircraft is described that includes an aperture that is mounted at an angle relative to the horizon plane that does not change during system operation. Additional angle of elevation for adjustment of azimuth is provided by electronic means, such as a Rotman lens, while rotation within the horizon plane is provided by a rotating mechanism. Also disclosed is a radome for use with such an antenna system, which is provided dimensioned to accommodate the at a large value of the mounting angle and which can be trimmed to accommodate the system at smaller values of the mounting angle in order to minimize the impact on aircraft aerodynamics.

20 Claims, 7 Drawing Sheets

(51) Int. Cl.

| | |
|---|---|
| ***H01Q 3/06*** | (2006.01) |
| ***H01Q 3/26*** | (2006.01) |
| ***H01Q 1/24*** | (2006.01) |
| ***H01Q 1/42*** | (2006.01) |

(52) U.S. Cl.
CPC ..... *H01Q 3/04* (2013.01); *H01Q 3/06* (2013.01); *H01Q 3/26* (2013.01)

(56) References Cited

U.S. PATENT DOCUMENTS

| | | | | |
|---|---|---|---|---|
| 5,294,939 | A | 3/1994 | Sanford et al. | |
| 5,485,170 | A * | 1/1996 | McCarrick ..... | H01Q 1/3275 343/713 |
| 6,259,415 | B1 * | 7/2001 | Kumpfbeck ..... | H01Q 3/08 343/765 |
| 7,061,432 | B1 | 6/2006 | Tavassoli Hozouri | |
| 7,095,376 | B1 * | 8/2006 | Timothy ..... | H01Q 1/125 343/705 |
| 7,554,489 | B2 | 6/2009 | Tsai et al. | |
| 8,120,537 | B2 | 2/2012 | del Rio et al. | |
| 9,527,497 | B2 | 2/2016 | Tiezzi et al. | |
| 2005/0146473 | A1 * | 7/2005 | Stoyanov ..... | H01Q 1/1264 343/753 |
| 2005/0259020 | A1 | 11/2005 | Lo Forti et al. | |
| 2006/0071867 | A1 * | 4/2006 | Quagliaro ..... | H01Q 1/28 343/705 |
| 2006/0284775 | A1 | 12/2006 | Kaplan et al. | |

OTHER PUBLICATIONS

Henderson, W.H. et al., "Wireless Communication Applications of the Continuous Transverse Stub (CTS) Array at Microwave and Millimeter Wave Frequencies", IEEE Wireless Communications and Applied Computational Electromagnetics, Apr. 3-7, 2005.

Johnson, M.C. et al., "Sidelobe Canceling for Optimization of Reconfigurable Holographic Metamaterial Antenna", IEEE Transactions on Antennas and Propagation, Jul. 18, 2014.

"Comms on the Move", Phassor, product information sheet, obtained Nov. 11, 2016.

"Panasonic wows with new phased array antenna for inflight Internet", Runway Girl Network, screen capture Dec. 21, 2016, https://www.runwaygirlnetwork.com/2014/09/16/panasonic-wows-new-phased-array-antenna-inflight-internet/.

"Slim-Fit Connectivity—Panasonic Offers New Ultra Low Profile Aeronautical Antenna: Low-Profile Architecture Cuts Operational Expenses for Wi-Fi Equipped Aircraft", screen capture Dec. 21, 2016, http://www.prnewswire.com/news-releases/slim-fit-connectivity-panasonic-offers-new-ultra-low-profile-aeronautical-antenna-275315741.html.

"Thin Air Falcom-Ku 3030: Office-in-the-Air Connectivity", ThinKom product sheet, Aug. 2014.

"Aero Mobile Terminals: Models 2540/2532", Via Sat product sheet, 2012.

"Whitepaper: Aeronautical Broadband for Commercial Aviation: Evaluating the 2Ku Solution", screen capture Dec. 21, 2016, http://concourse.gogoair.com/whitepaper-aeronautical-broadband-commercial-aviation-evaluating-2ku-solution/.

Henry, C. et al., "Panasonic, Boeing Lightweight Antenna to Offer IFC, Reduced Emissions" Young Engineers Satellite Society, Oct. 8, 2014, http://www.satellitetoday.com/telecom/2014/10/08/panasonic-boeing-lightweight-antenna-to-offer-ifc-reduced-emissions/.

* cited by examiner

HYBRID STEERABLE AVIONIC ANTENNA

This application claims the benefit of U.S. Provisional Application No. 62/165,633, filed May 22, 2015. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is antennas for avionic use, more specifically antennas utilized in satellite communications.

BACKGROUND

The following description includes information that may be useful in understanding the present invention. It is not an admission that any of the information provided herein is prior art or relevant to the presently claimed invention, or that any publication specifically or implicitly referenced is prior art.

Provision of aircraft with the ability to link to satellite communication networks necessarily entails the use of antenna, which is generally external to an aircraft. Unlike ground-based or maritime craft, however, the need to provide a suitably aerodynamic profile sets limitations on the size and configuration of such antennae that can limit their performance.

One antenna configuration currently in avionic use is a rectangular antenna that lies along or is angled relative to the aircraft's surface (type 1). Such an antenna is steered mechanically to adjust azimuth. Similarly, elevation is adjusted mechanically. Such antennae are commercially available through Panasonic® and through Viasat®. Another antenna configuration currently in avionic use is a fixed antenna that lies along the aircraft's surface, generally having a circular shape that is steered electronically in both azimuth and elevation (type 2). Such antennae are commercially available through Thinkom®, Kymeta®, and Phasor®, for example. Generally, a type 1 antenna has a higher antenna profile (d) than a comparable type 2 antenna, which is undesirable from an aerodynamic standpoint. There are, however, important differences in performance characteristics.

An important factor in the suitability of the performance of such antennas is their performance at different latitudes, as communications satellites are generally placed in equatorial orbits (i.e. 0° latitude). This is largely a function of the antenna gain. Antenna gain can be understood as the power flux of a signal intercepted by the effective aperture ($A_e(\varepsilon)$) in a specified direction. Generally, at a given elevation angle ε, gain ($G(\varepsilon)$) can be calculated using the following formula:

$$G(\varepsilon)=\eta(4\pi A_e(\varepsilon)/\lambda^2)$$

For type 1 antennae, $A_e$ (ε) is effectively the area of the rectangular antenna surface (A1). For type 2 antennae, $A_e$ (ε) is the area of the antenna surface multiplied by the sine of the elevation angle (i.e. A2*sin(c)). As a result, all other factors (e.g., efficiency, frequency, footprint, etc.) being equal, the gain of a type 1 antenna remains constant at different elevation angles while the gain of a type 2 antenna is sharply reduced at low elevation angles (see FIG. 1). Consequently, an antenna of type 1 configuration would be expected to support satellite communication over a broader range of latitudes than an antenna with a type 2 configuration having a similar footprint. Such type 1 antennae, however, have a skew angle issue resulting from beam asymmetry that limits their use at longitudes far from the target satellite (due to interference to neighboring satellites). Antennae having a type 2 configuration have less of a skew angle issue; however, this reduction in interference to neighboring satellites is accompanied by reduced gain at higher latitudes. These effects are shown in FIG. 2A (showing the relationship between gain, attitude, and relative longitude for a type 1 antenna) and FIG. 2B (showing the relationship between gain, latitude, and relative longitude for a type 2 antenna).

An at least partial solution to the skew angle problem experienced with type 1 antennas is to electronically distort or rotate the asymmetric beam produced so that the longer plane of the beam is orthogonal to the arch described by the set of communication satellites. While this can reduce the amount of interference to non-target satellites, such a solution adds to the complexity of the communication system and may not be suitable for harsh operating environments (where mechanical systems can be more reliable). In addition, such a solution does not address the differences in antenna profile. Recently, phased array solutions have been provided but are, to date, prohibitively expensive for many uses. As a result, current technology provides either a wide coverage antenna with an undesirably high profile or a low profile antenna with relatively low coverage.

Thus, there is still a need for an antenna design that supports communication over a wide range of latitudes while minimizing the antenna profile.

SUMMARY OF THE INVENTION

The inventive subject matter provides devices and systems wherein a telecommunications antenna system is provided with an aperture that is mounted at a pre-fixed angle relative to the horizon plane that does not change during system operation. Additional angle of elevation for adjustment of azimuth is provided by electronic means, such as a Rotman lens, while rotation within the horizon plane is provided by a rotating mechanism.

One embodiment of the inventive concept is a telecommunications antenna that includes an aperture (which can have receiving and/or transmitting functions) that is inclined at a predetermined, non-zero angle relative to a horizon plane, a rotating assembly that is coupled to the aperture and that rotates the aperture around an axis that is perpendicular to the horizon plane, and an electronic steering assembly that adjusts the elevation angle of the aperture. The aperture may preferably comprise a substrate or surface on which transmitting and/or receiving elements can be disposed, preferably in a non-striped configured such that all of the transmitting and/or receiving elements lie along the same plane.

The predetermined, non-zero angle (which can range from less than 1° to 20°) is fixed during operation of the telecommunications antenna. This predetermined, nonzero angle can be fixed during manufacture and/or at installation on the aircraft. In some embodiments, the predetermined, non-zero angle can be adjusted after installation. The value of the predetermined, non-zero angle is a function of both a desired range of latitude operations for an aircraft and a desired configuration of a radome of the aircraft. The electronic steering assembly provides adjustment of the elevation angle of the aperture, for example providing adjustment of up to 110° from the predetermined, non-zero angle.

Another embodiment of the inventive concept is a radome dimensioned to enclose the elements of the telecommunications antenna for installation on the exterior of an aircraft. Such a radome can be shaped and dimensioned to accommodate these elements when the aperture is set at the maximum predetermined, fixed angle (for example 20°), and can be configured to accommodate smaller predetermined, fixed angles by trimming material from its edge. In some embodiments the radome can be provided with markings that indicate what material should be removed to accommodate a specified predetermined, fixed angle for the aperture.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 3A shows the antenna mounted at a fixed angle, and provided with mechanical rotation for adjustment of azimuth. FIG. 3B depicts electronic adjustment of elevation.

FIG. 4A depicts different radomes suitable for use with an antenna system of the inventive concept. FIG. 4B depicts the impact of the value of the fixed angle of the antenna on radome height, as well as minimum elevation.

DETAILED DESCRIPTION

Figure 1:
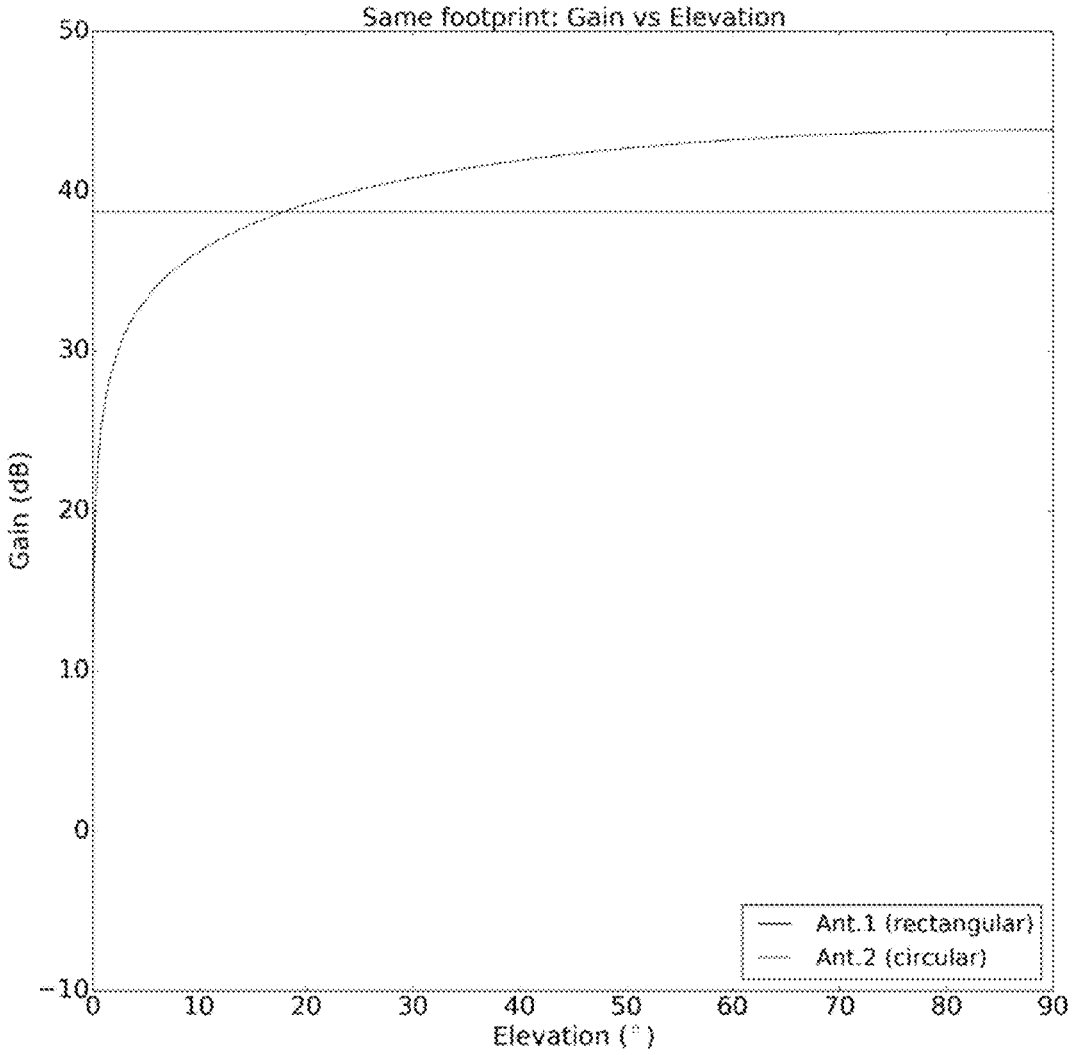
PRIOR ART FIG. 1
FIG. 1 depicts the relationship between antenna gain and elevation angle for two prior art antenna configurations.
Figure 2A:
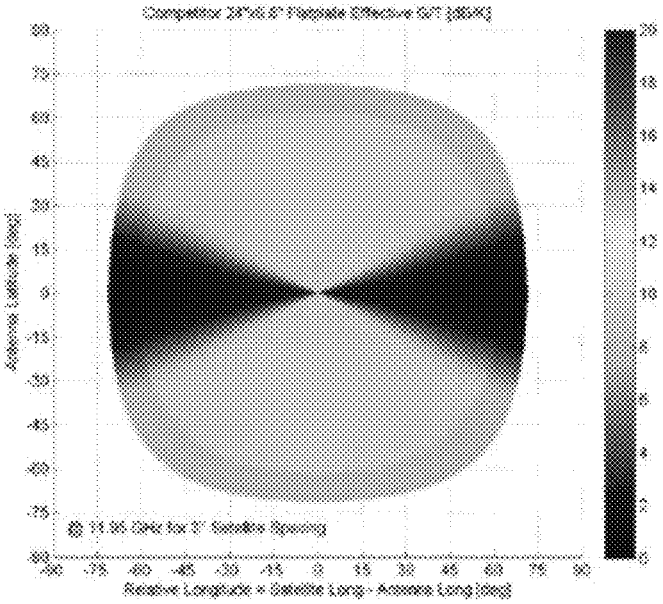
PRIOR ART FIG. 2A
FIGS. 2A and 2B depict the relationship between gain, latitude, and relative longitude for type 1 and type 2 prior art antenna configurations, respectively.
Figure 2B:
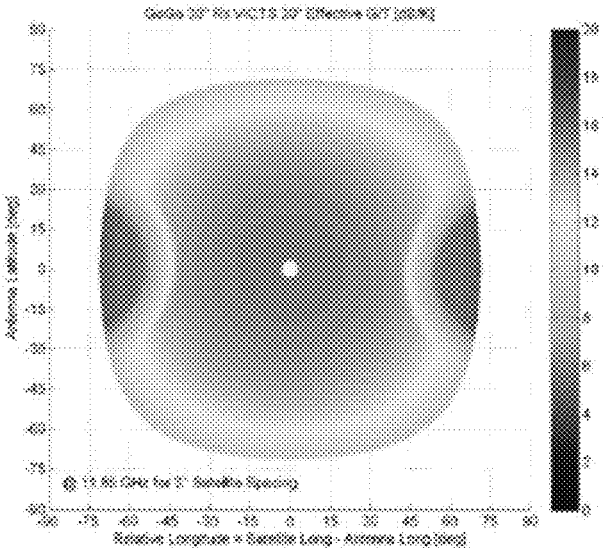
PRIOR ART FIG. 2B

The inventive concept provides an antenna suitable for use in communication between an aircraft and a communication satellite. Such an antenna can include an antenna element or aperture that has a receiving function, a transmitting function, or that can incorporate both receiving and transmitting functions. An antenna of the inventive concept can be of a hybrid design that utilizes mechanical adjustment of azimuth (e.g. by rotation) and utilizes electronic steering to adjust elevation (for example, through the use of a Rotman lens). In some embodiments, the antenna's aperture is pre-inclined at a fixed angle (θ), such as during installation, and mechanical rotation is performed around a vertical axis relative to the horizon plane. The angle θ provides a trade-off in the range of latitudes over which the antenna provides adequate performance and the profile height (d) of the antenna. In some embodiments, θ is determined at the time of construction and/or installation of the antenna system and is not altered during normal operations. An aircraft manufacturer and/or operator can select an angle θ that provides adequate performance over the range of operation of the aircraft while minimizing the impact of the antenna system on the aircraft's aerodynamic contour. It should be appreciated that devices and systems of the inventive concept advantageously provide a robust and effective antenna system that permits aircraft to communicate with telecommunications satellites within their operating latitudes while minimizing the impact on aircraft performance.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Figure 3A:
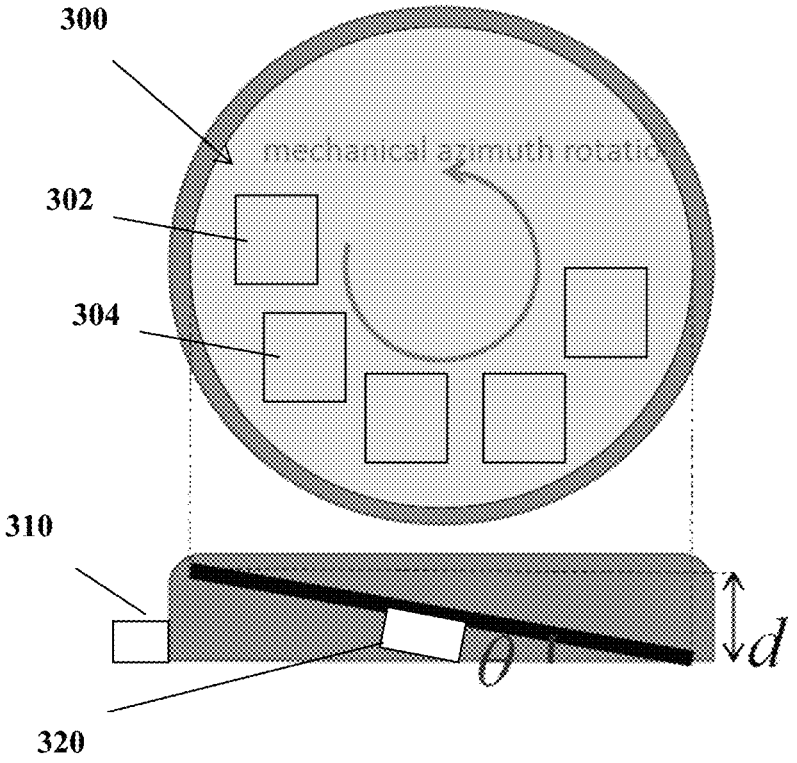
FIGS. 3A and 3B depict an antenna of the inventive concept.
Figure 3B:
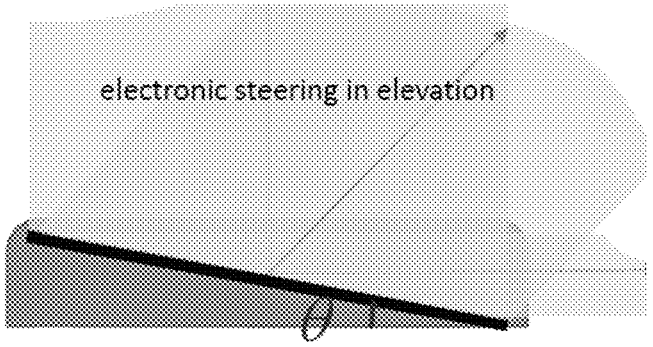

FIGS. 3A and 3B depict an exemplary antenna of the inventive concept. As shown in FIG. 3A, the antenna is mounted at a fixed angle θ, and is rotated to adjust azimuth by mechanical means 320. The antenna has an aperture 300 comprising transmitting elements 302 and receiving elements 320. The angle θ defines a height d relative to the horizon plane, which is accommodated within an aerodynamic enclosure in use. The angle θ is fixed during use. In some embodiments, the angle θ is integrated into the design of the system on manufacture. In other embodiments, the angle θ is determined by a mechanism that is provided by the manufacturer as an adjustable mechanism, and is fixed at the desired angle on installation. In still other embodiments the angle θ is determined by a mechanism that is provided by the manufacturer as an adjustable mechanism, is reversibly fixed at a desired angle on installation. In such an embodiment, the angle θ can be maintained during flight operations, however the angle θ can be adjusted by an aircraft operator if so desired when not in flight (for example, if an aircraft is moved to a different region or route for which the initial angle θ is undesirable). Such an adjustment can be accompanied by a change of a radome, cowl, or similar aerodynamic enclosure of the antenna system in order to provide a suitably minimal impact on the aircraft's aerodynamic contour.

As shown in FIG. 3B, elevation adjustment is provided from the fixed angle θ by electronic means, for example by electronic steering 310 (shown in FIG. 3A). Such electronic steering can be accomplished by any suitable method. In a preferred embodiment elevation adjustment is provided by a Rotman lens. Such electronic steering can provide elevation angles in addition to that provided by the angle at which the antenna aperture is mounted. For example, such angles can extend up to 110° or more from the fixed angle θ.

Figure 4A:
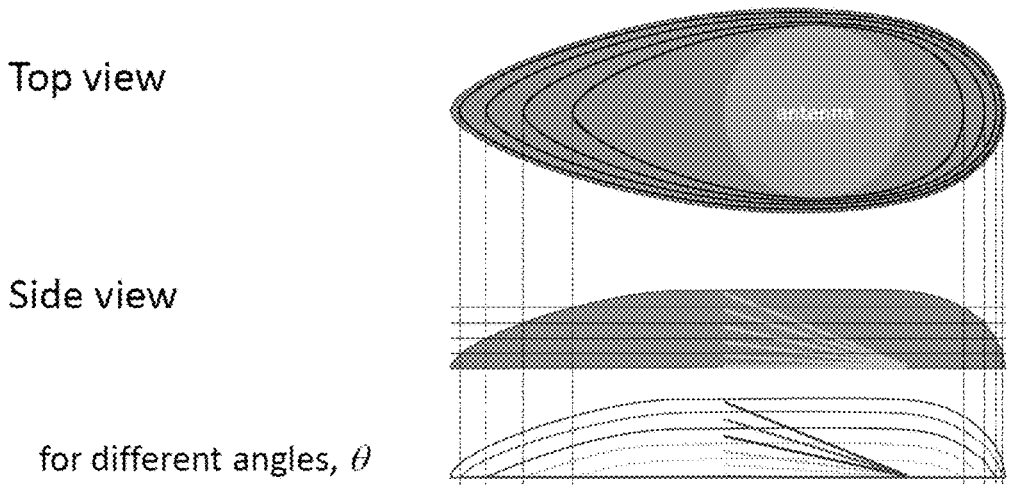
FIGS. 4A and 4B shows the impact of the value of the fixed angle of the antenna on radome configuration.

As noted above, antenna systems of the inventive concept can be provided at different fixed angles. Use of greater fixed angles necessarily increase the height d of the antenna, and can necessitate the use of different radome configurations. FIG. 4A depicts an example of a set of different radome configurations that can be provided to accommodate a given antenna system of the inventive concept where the antenna element is held at different fixed angles. As shown, great values for θ in the same antenna system can necessitate the use of radomes of increasing height, length, and/or breadth.

Figure 4B:
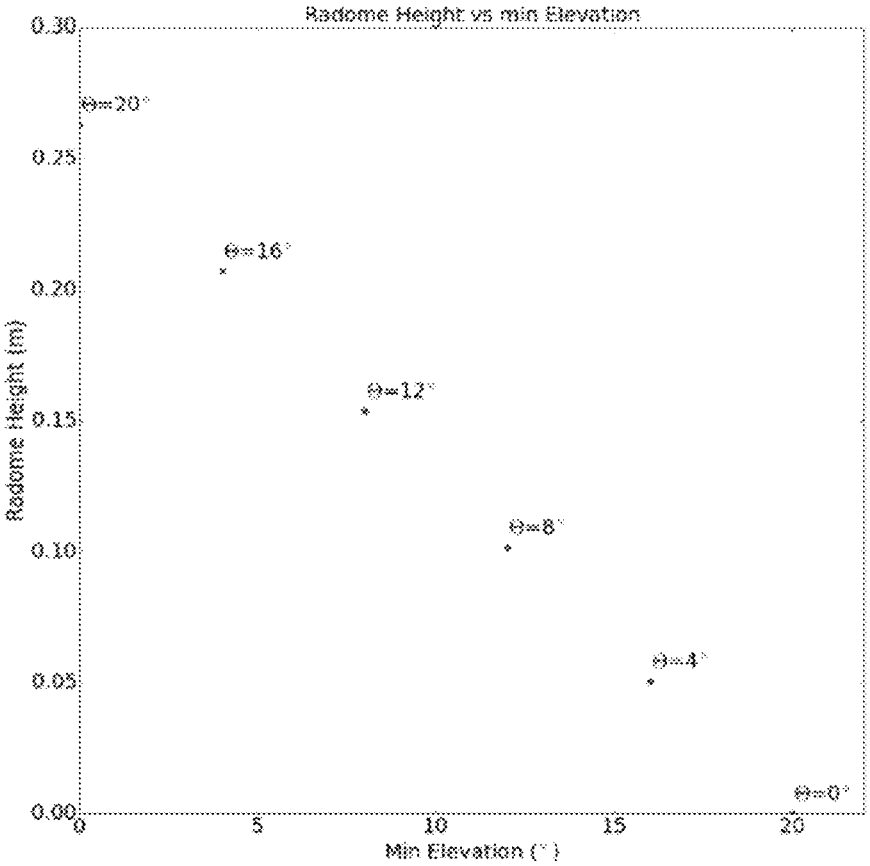

One embodiment of the inventive concept is a radome that is provided in a configuration that can accommodate an antenna system of the inventive concept at a maximum value of θ (for example 20°), and which can be trimmed by removal of peripheral material to accommodate the antenna system at smaller values of θ. A graph depicting the relationship between radome height and different values for θ for an exemplary antenna of the inventive concept is shown in FIG. 4B. It should be appreciated that radome height can impact aircraft performance, and that the selection of a value for θ for a given installation can represent a balance between desired telecommunication and aerodynamic performance. In some embodiments, assuming the use of a circular antenna, the height d of the antenna that defines the radome height can be calculated using:

$$d=\sqrt{(A_3/\pi)}\tan\theta$$

where $A_3$ is the area of the antenna.

Figure 5:
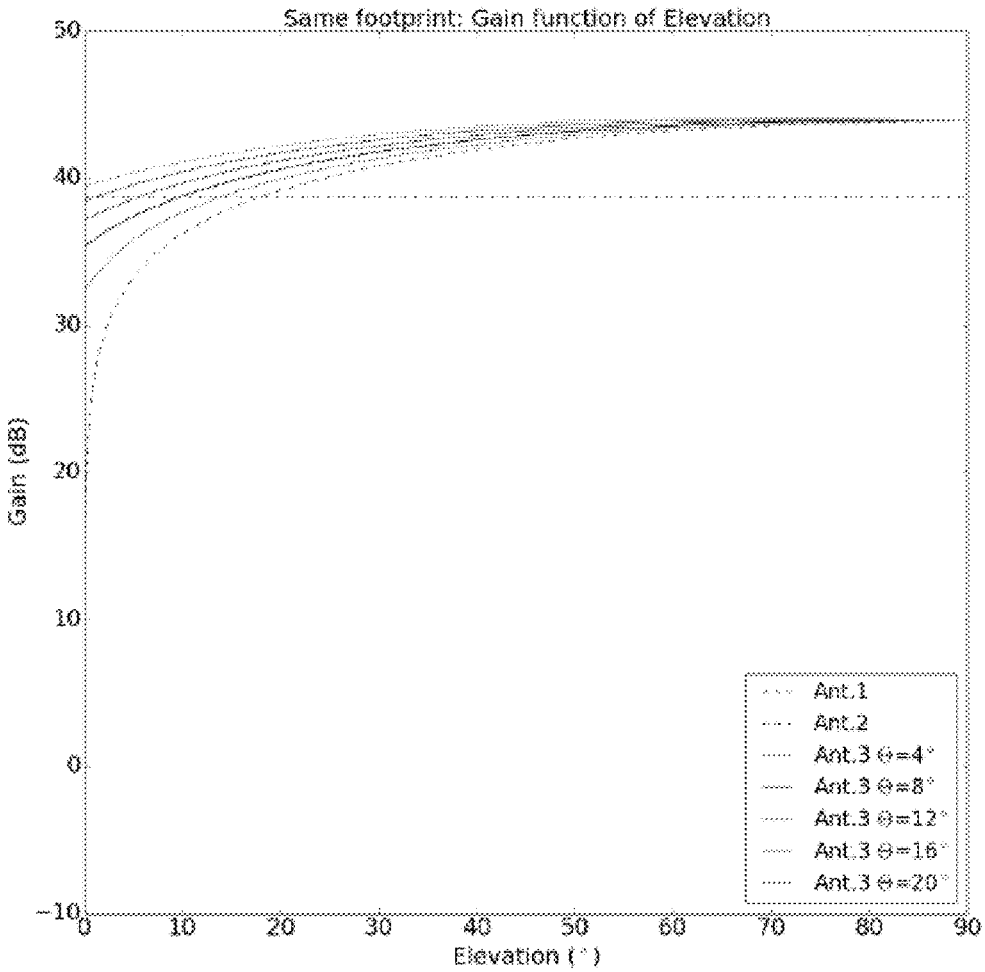
FIG. 5 shows a comparison between the performance of prior art antennas and a series of antennae of the inventive concept with different fixed angles of elevation.

FIG. 5 depicts a comparison between the performance of a type 1 antenna of the prior art (Ant. 1), a type 2 antenna of the prior art (Ant. 2) and a series of antennae of the inventive concept (Ant. 3) mounted at different values of θ. All antennae have the same footprint. As shown, antennae of the inventive concept consistently show improved performance over prior art designs. While values for θ are shown as ranging from 4° to 20°, it should be appreciated that suitable angles for θ can range from less than 1°, about 1°, about 2°, about 3°, about 4°, about 5°, about 6°, about 7°, about 8°, about 9°, about 10°, about 12°, about 14°, about 16°, about 18°, and about 20°.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary. The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Figure 6:
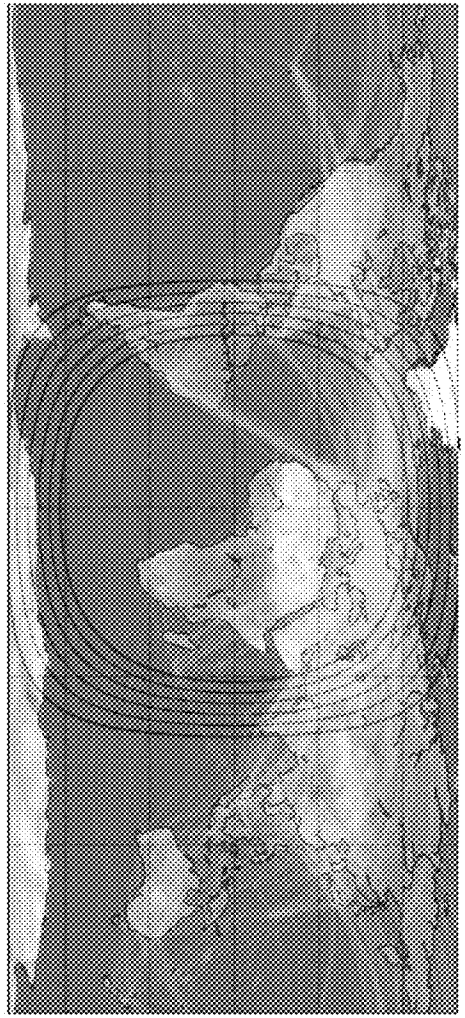
FIG. 6 shows a contour map of the elevations at which an exemplary antenna of the inventive concept can be used for telecommunications as a function of the fixed angle of elevation. Contours begin centrally at 0° and advance at 4° intervals.

The elevation angle θ impacts the latitudes at which an aircraft-mounted antenna system of the inventive concept can be used for satellite communication. FIG. 6 depicts a contour map of effect of different values for fixed angle θ on operating latitude. These are shown as a contour superimposed on a world map, with the innermost contour depicting operating elevation at θ=0°, the next contour moving outwards depicting operating elevation at θ=4°, the next contour moving outwards depicting operating elevation at θ=4°, the next contour moving outwards depicting operating elevation at θ=8°, the next contour moving outwards depicting operating elevation at θ=12°, the next contour moving outwards depicting operating elevation at θ=16°, and the outermost contour depicting operating elevation at θ=20°.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A telecommunications antenna, comprising:

a planar substrate disposed on a horizon plane;

a radiating aperture disposed in a single, substantially flat plane, and integrated with the planar substrate such that the radiating aperture is fixedly inclined at a predetermined, nonzero angle relative to the plane of the substrate;

transmitting and receiving elements interlaced across the radiating aperture, such that the transmitting and receiving elements are fixedly inclined at the predetermined, nonzero angle;

a rotating assembly coupled to the substrate, and configured to rotate the radiating aperture around an axis that is perpendicular to the horizon plane, to permit pointing of the antenna in azimuth; and an electronic beam steering assembly configured to adjust the pointing angle of the radiating aperture along a second plane that is perpendicular to the horizon plane, to enable the pointing of the antenna in elevation, wherein the predetermined, nonzero angle is fixed during operation of the telecommunications antenna.

2. The telecommunications antenna of claim 1, wherein the predetermined, nonzero angle is fixed on installation of the telecommunications antenna.

3. The telecommunications antenna of claim 1, wherein the predetermined, nonzero angle is fixed on manufacture of the telecommunications antenna.

4. The telecommunications antenna of claim 1, further comprising an adjustment mechanism configured to permit adjustment of the predetermined, nonzero angle following installation of the telecommunications antenna.

5. The telecommunications antenna of claim 1, wherein the predetermined, nonzero angle is from 1 to 20°.

6. The telecommunications antenna of claim 1, where the predetermined, nonzero angle is a function of both a desired range of latitude operations for an aircraft and a desired configuration of a radome of the aircraft.

7. The telecommunications antenna of claim 1, wherein the electronic beam steering assembly is configured to adjust the pointing angle of the radiating aperture from the predetermined, nonzero angle to 110°.

8. The telecommunications antenna of claim 1, further comprising a radome comprising a peripheral edge, wherein the radome is provided configured to accommodate the radiating aperture, the rotating assembly, and the electronic beam steering assembly at a maximum value of the predetermined, nonzero angle, and is adjustable to accommodate the radiating aperture, the rotating assembly, and the electronic beam steering assembly at a non-maximum value of the predetermined, nonzero angle by removal of all or part of the peripheral edge.

9. The telecommunications antenna of claim 8, wherein the maximum value of the predetermined, nonzero angle is 20°.

10. The telecommunications antenna of claim 8, wherein the radome comprises indicia marking portions of the peripheral edge to be removed to accommodate different values of the predetermined, nonzero angle.

11. The telecommunication antenna of claim 1, wherein the receiving and transmitting elements are interlaced across the radiating aperture in a non-striped configuration along the single, substantially flat plane.

12. A low-profile avionics antenna having a fixed inclination during operation of the antenna, comprising:

a radiating aperture disposed in a first plane on a planar mounting surface having a circular cross-section, wherein the planar mounting surface is fixedly inclined at installation to a predetermined, nonzero angle relative to a horizon plane that is less than 20°;

transmitting and receiving elements interlaced across the radiating aperture at the fixed non-zero angle and along the first plane, such that the transmitting and receiving elements are fixedly inclined at the predetermined, nonzero angle;

a rotating assembly coupled to the mounting surface, and configured to rotate the radiating aperture around an axis that is perpendicular to the horizon plane, to enable the pointing of the antenna in azimuth; and an electronic beam steering assembly configured to adjust the pointing angle of the radiating aperture along a second plane that it perpendicular to the horizon plane, to enable the pointing of the antenna in elevation.

13. The avionics antenna of claim 12, wherein the predetermined, nonzero angle is fixed on installation of the antenna.

14. The avionics antenna of claim 12, wherein the predetermined, nonzero angle is fixed on manufacture of the antenna.

15. The avionics antenna of claim 12, further comprising an adjustment mechanism configured to permit adjustment of the predetermined, nonzero angle following installation of the antenna.

16. The avionics antenna of claim 12, where the predetermined, nonzero angle is a function of both a desired range of latitude operations for an aircraft and a desired configuration of a radome of the aircraft.

17. The avionics antenna of claim 12, wherein the electronic beam steering assembly is configured to adjust the pointing angle of the radiating aperture from the predetermined, nonzero angle to 110°.

18. The avionics antenna of claim 12, further comprising a radome comprising a peripheral edge, wherein the radome is provided configured to accommodate the radiating aperture, the rotating assembly, and the electronic beam steering assembly at a maximum value of the predetermined, nonzero angle, and is adjustable to accommodate the radiating aperture, the rotating assembly, and the electronic beam steering assembly at a non-maximum value of the predetermined, nonzero angle by removal of all or part of the peripheral edge.

19. The avionics antenna of claim 18, wherein the radome comprises indicia marking portions of the peripheral edge to be removed to accommodate different values of the predetermined, nonzero angle.

20. The avionics antenna of claim 12, wherein the receiving and transmitting elements are interlaced across the radiating aperture in a non-striped configuration along the first plane.

* * * * *